United States Patent [19]

Dills

[11] 4,093,841

[45] June 6, 1978

[54] LOW-TEMPERATURE SLOW-COOKING MICROWAVE OVEN

[75] Inventor: Raymond L. Dills, Louisville, Ky.

[73] Assignee: General Electric Company, Louisville, Ky.

[21] Appl. No.: 716,015

[22] Filed: Aug. 19, 1976

[51] Int. Cl.[2] ..... H05B 9/06

[52] U.S. Cl. ..... 219/10.55 E; 219/10.55 B

[58] Field of Search ..... 219/10.55 E, 10.55 F, 219/10.55 M, 10.55 R, 10.55 B; 324/65 P

[56] References Cited

U.S. PATENT DOCUMENTS

| | | | |
|---|---|---|---|
| 2,919,336 | 12/1959 | Hahn | 219/10.55 R |
| 3,936,626 | 2/1976 | Moore | 219/10.55 E |
| 3,943,317 | 3/1976 | Nagamoto | 219/10.55 B |
| 3,975,720 | 8/1976 | Chen et al. | 219/10.55 E |
| 3,985,991 | 10/1976 | Levinson | 219/10.55 E |
| 4,017,702 | 4/1977 | Harmon | 219/10.55 B |
| 4,035,787 | 7/1977 | Hornung | 324/65 P |

*Primary Examiner*—Bruce A. Reynolds
*Attorney, Agent, or Firm*—Francis H. Boos

[57] ABSTRACT

A microwave oven for cooking food with microwave energy on a slow simmer cycle. The oven includes a closed vessel in which food is to be cooked slowly for many hours at a simmer temperature. A control apparatus is furnished for monitoring the temperature of the food in the vessel, and it has a temperature-sensing probe adjacent the bottom wall of the vessel. The probe is connected in circuitry for controlling the power level of the microwave energy to medium power, as well as controlling the maximum food temperature to just below a boiling temperature.

7 Claims, 3 Drawing Figures

LOW-TEMPERATURE SLOW-COOKING MICROWAVE OVEN

BACKGROUND OF THE INVENTION (1) Field of the Invention

This invention relates to microwave ovens for cooking food, and particularly to such ovens having a simmer cycle for cooking food slowly in a closed container at a simmer temperature for many hours of time.

(2) Description of the Prior Art

Microwave ovens have become widely accepted in many countries for the cooking of many foods at a fast cooking rate. The microwave frequency energy is radiated within the oven cooking cavity from an energy source such as a magnetron. The waves are radiated and reflected within the oven cavity in free space and are distributed by such means as mode stirrers, antennas, and the like. The microwave energy sets up a high-frequency oscillatory movement of the molecules in the food to cause internal heating by molecular friction.

Electric thermometer probes which monitor the internal temperature of the food while it is being cooked have been developed in recent years for use in microwave ovens. One example of such automatic temperature controls adapted for use in microwave ovens is taught in U.S. Pat. No. 3,975,720 of David Y. Chen and Louis H. Fitzmayer, which is assigned to the same assignee as is the present invention. Such probes comprise a long needle-like probe adapted to be positioned in the food, and with a temperature-sensing element, such as a thermistor, positioned internally of the probe housing near the tip thereof. A flexible shielded cable connects the thermistor to control circuitry which is responsive to thermally-induced changes in its resistance. The cable shield is connected at one end to the probe housing and at the other end to a wall of the oven cooking cavity for grounding purposes. The design of this probe and its cable has been carefully selected so that they may successfully be operated in a microwave oven with minimal direct heating of the probe and cable by the microwave energy. Prior to the Chen/Fitzmayer invention, microwave cooking had been accomplished using timed cycles. It was necessary to weigh the food and measure its thickness or depth and set the correct power level before attempting to estimate the correct amount of time for cooking the food. Only successful experiences would make a person confident enough to avoid overcooking the food. The introduction of the automatic temperature control of the Chen/Fitzmayer invention allows the food to be cooked to a pre-set temperature so that the cooking operation is automatic and the guesswork has been eliminated. When the pre-set internal food temperature is reached, the oven automatically turns itself off and a buzzer sounds to signal that the food is ready for serving. Electric meat thermometers have been used before in standard electric and gas cooking ovens, but an automatic temperature control is much more important in a microwave oven because once the microwave power is de-energized, the cooking operation ceases immediately. In standard electric and gas ovens, the cooking action continues even after the electric heaters are de-energized and the gas burners are extinguished unless the food is removed from the oven. This is true because of the stored heat energy in the electric heating elements or the gas burners and the heat in the oven walls and insulation, and the cooking container. Microwave cooking is cool cooking because the heating effect takes place directly in the food throughout simultaneously, and not from the heat of the container for the food or from the heat of the walls of the oven liner and oven door.

While microwave oven cooking is the fastest growing segment of the range industry, some people are reluctant to purchase a microwave oven because they feel no urgent need to cook faster and, furthermore, they do not perceive fast cooking to be good cooking of the type they desire to routinely serve their family. On the other hand, the majority of people attribute slow cooking and simmering with high quality end results of nutrition, tenderness, flavor, economy and convenience, ever with cheaper cuts of meat. Market surveys indicate that there is very little routine main course meal preparation with the microwave oven. Owners tend to use it often but in a very limited way.

Another fast growing branch of the food preparation equipment industry is the modern electric slow-cooking pots where it is possible to enjoy delicious simmered-in flavors of many popular dishes without the time-consuming necessity of constant attention. It is possible to set the slow-cooking pots in operation and leave for work or spend the day away from the home, or for cooking during the night for use the next day. The slow-cooking pots mingle the flavors and the spices and retain many of the vitamins that high temperatures destroy. It is possible to return home to a piping hot dinner that is ready to serve, and it doesn't matter if you return at any exact hour. The food won't burn or taste overcooked if it is heated several hours longer than planned. Dinner is ready whenever it is desired. Nourishing meals can be prepared with inexpensive meats because slow cooking tenderizes in a special way that broiling or frying cannot match. The meats are juicy and never cooked dry because slow-cooking pots seal in the moisture. Electric slow-cooking pots are popular because on a low setting it uses less energy than a 100-watt bulb, and it is possible to cook all day for only a few pennies. Accordingly, slow cooking makes good eating.

The principal object of the present invention is to provide a controlled temperature microwave oven with a slow simmer cycle in order to expand the utility of microwave oven cooking to be able to handle most kinds of food over a wide range of cooking methods while retaining the convenience of automatic temperature and timed controls, and variable power.

A further object of the present invention is to attain increased cooking versatility by combining the advantages of both microwave oven cooking and electric slow-cooking pots.

A further object of the present invention is to provide a microwave oven of the class described with a closed cooking container that is joined to the automatic temperature control system of the oven so that the food temperature is held at just below a boiling temperature for an unlimited period of time without overcooking.

A further object of the present invention is to provide a microwave oven with a simmer cycle using a closed cooking container that is transparent to microwave energy so that the food is heated directly by absorption of the microwave energy.

A further object of the present invention is to provide a microwave oven of the class described using an automatic temperature control system with a temperature-sensing probe associated with the bottom wall of the cooking container but not directly within the cooking vessel.

A further object of the present invention is to provide a slow-cooking microwave oven that is capable of defrosting frozen food and then simmer cooking the food in a single automatic operation.

A further object of the present invention is to provide a microwave oven of the class described where the temperature-sensing probe is inserted into a tunnel in the bottom wall of the cooking container for good thermal conduction of heat from the food load being cooked.

SUMMARY OF THE INVENTION

The present invention, in accordance with one form thereof, relates to a microwave oven having an oven cooking cavity and a source of microwave energy with means for coupling the energy to the oven cavity. A closed cooking vessel is installed in the oven, and there is an automatic temperature control system for maintaining the temperature of the food within the vessel to just below the boiling point so that the food may be cooked for an almost unlimited period of time at a slow cooking rate.

BRIEF DESCRIPTION OF THE DRAWINGS

This invention will be better understood from the following description taken in conjunction with the accompanying drawings and its scope will be pointed out in the appended claims.

DESCRIPTION OF THE PREFERRED EMBODIMENT

Figure 1:
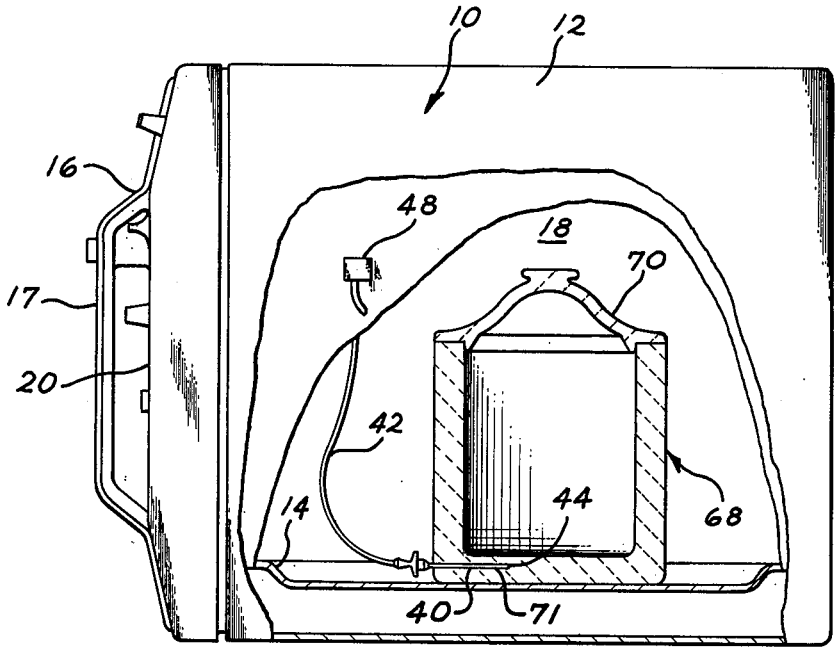
FIG. 1 is a left side elevational view of a countertop microwave oven with parts broken away to show the interior of the oven in which is positioned a closed cooking vessel in which is inserted in the bottom wall a temperature-sensing probe of an automatic temperature control system.
Figure 2:
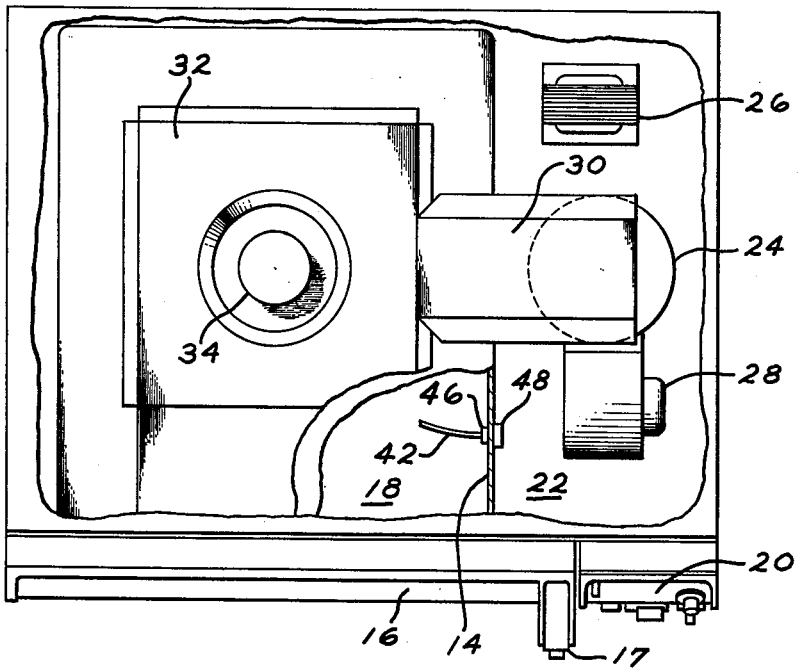
FIG. 2 is a top plan view on a reduced scale of the microwave oven of FIG. 1 with parts broken away to show the cooperation between the oven cooking cavity and the equipment compartment to the right side of the oven door for receiving the magnetron and its power supply and the control components and waveguide for feeding the microwave energy to the cooking cavity.

Turning now to a consideration of the drawings, and in particular to FIG. 1, there is shown a microwave oven 10 which is provided with an outer cover 12 that encloses a box-like oven liner 14 that cooperates with a front-opening access door 16 with handle 17 for forming an oven cooking cavity 18. To the right side of the oven door 16 is a control panel 20 behind which is an equipment compartment 22 which extends to the back of the oven and contains the various control and power components such as the source of microwave energy, magnetron 24, and power supply 26 and a motor blower unit 28 beneath the magnetron for blowing cool ambient air over the magnetron and into a rectangular waveguide 30 which is connected to a feedbox 32 in which is supported a mode stirrer (not shown) that is driven by a pancake motor 34 at the top of the oven.

Figure 3:
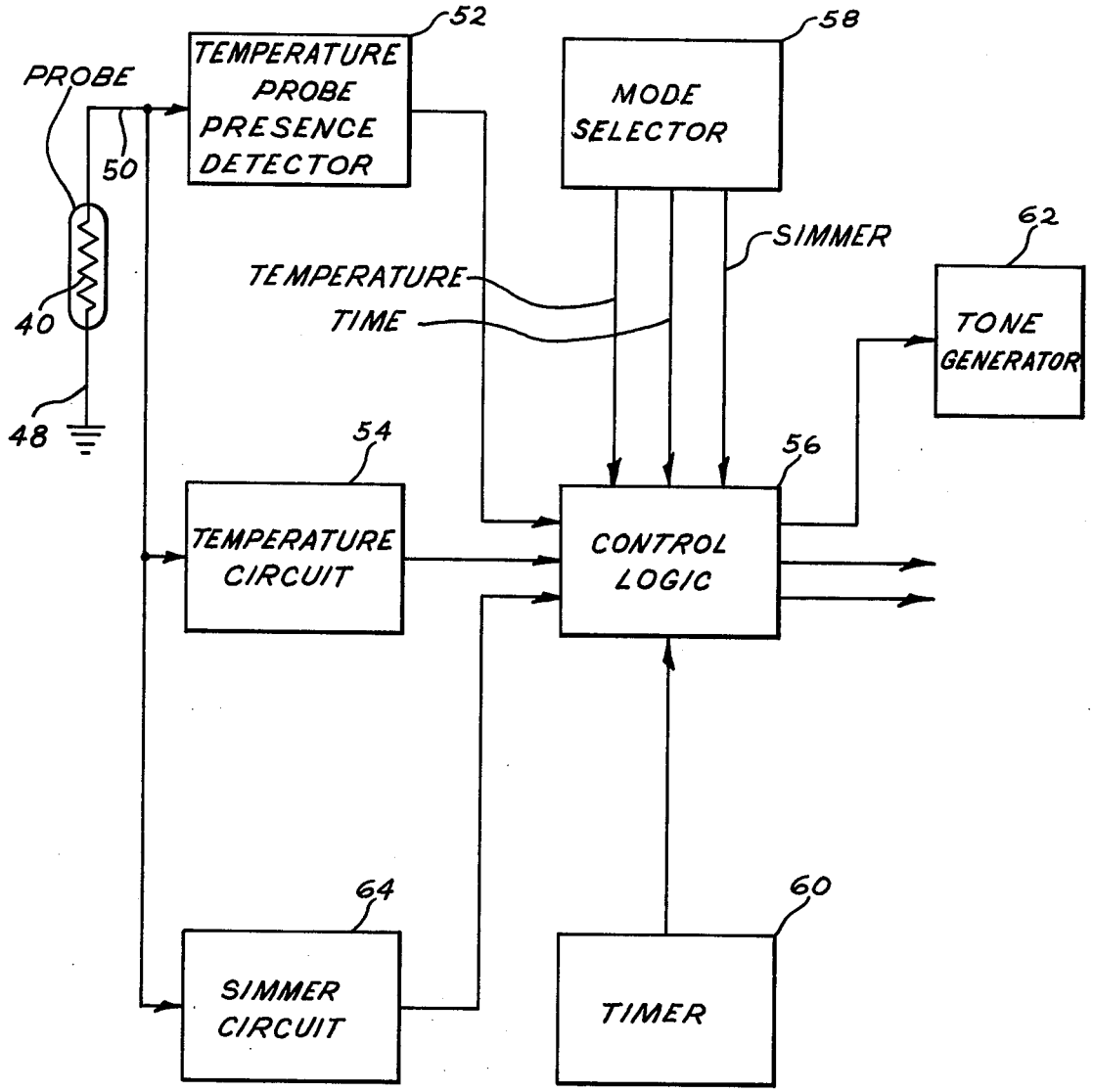
FIG. 3 is a fragmentary block diagram of the automatic temperature control system of the present invention.

The microwave oven 10 is provied with an automatic temperature control system comprising a temperature-sensing probe 40 having a flexible shielded cable 42 for electrically connecting the probe to control circuitry as is outlined in the block diagram of FIG. 3. The probe 40 has a tubular housing surrounding a temperature-sensing element such as a thermistor (not shown) in the tip thereof, as at 44. The cable 42 is preferably a shielded cable and it is provided with a plug 46 on one end for connecting into a connector 48 in one side wall of the oven liner. As mentioned earlier, the nature of the temperature-sensing probe 40 and its shielded cable 42 are best described in the recent patent of Chen/Fitzmayer, U.S. Pat. No. 3,975,720 entitled "Food Thermometer For Microwave Oven." Also, the particular cobntrol and power circuitry for the oven is best described in a copending patent application of Richard E. Hornung, Ser. No. 624,336 entitled "Food Temperature Responsive Control Apparatus." now U.S. Pat. No. 4,035,787.

In the block diagram of the automatic temperature control system of FIG. 3, the temperature-sensing probe 40 is shown with a grounded lead 48 that is grounded through the cable plug 46 to the oven body 12 and then to the grounded conductor of the power cable for the oven. Another lead 50 is joined to a temperature probe presence detector 52 which insures that the oven will not operate if it is set for the temperature control mode and the probe cable 42 is not plugged into its connector 48. The lead 50 is also connected to a temperature circuit 54 which in turn is connected to control logic 56. There is also a mode selector 58 which has a first temperature mode and a second time mode. Also joined to the control logic is an oven timer 60. A sound or tone generator 62 is provided so that when the timed cycle has been completed a buzzer or bell will sound. This control circuit is basically that of the above-mentioned Hornung application Ser. No. 624,336, but it has been modified to add a third position to the mode selector 58; namely, a simmer position, and, also, there is a simmer circuit 64 which adjusts the power level of the magnetron to a medium power of about 55% of rated power, or between 300 and 400 watts. Also, the simmer circuit will combine with the temperature circuit 54 to select a simmer temperature of about 190° F. which is just slightly below a boiling temperature of 212° F. This temperature is important because bacteria may grow in food at temperatures between about 40° F. and 150° F. At temperatures above that amount, the bacteria is destroyed by the heat energy so that no danger of food poisoning is present. The food to be cooked may remain in the microwave oven for periods of time from two hours to about ten hours cooking time, or more. If the food were not heated high enough, that is if the temperature were allowed to drop to below 170° F., then the food may not be safe to eat under all conditions. Also, it is important that the food heat-up rate be relatively fast so the food does not remain in the 40° F. to 150° F. temperature range for more than 30 minutes.

Turning back to FIG. 1, the oven is provided with a closed cooking vessel 68 in the form of a deep container having a removable cover 70. The container 68 is shown as a glass-ceramic or stoneware pot that is transparent to microwave energy. The cover 70 is also transparent to microwave energy and, preferably, it is also transparent for viewing the contents of the food through the window of the oven door 16. It is not absolutely necessary that the container 68 have a high heat mass as is shown in the drawing. It could just as well be of thin-wall, glass-ceramic material, such as Pyroceram or the like. The bottom wall of the container 68 is provided with a tunnel 71 extending radially from one side of the container for receiving the insertion of the probe 40 therein so that the tip 44 of the probe would be near the center of the bottom wall of the container to be substantially in heat transfer relation with the food to be cooked in the container.

Described above is the invention of a microwave oven provided with a simmer cycle for use with a closed container for cooking food therein with microwave energy at a medium power level of about one-half of rated power and at a maximum fixed temperature slightly below the boiling temperature so that the food may be cooked for an indefinite amount of time of between two to ten hours so as to enhance the food and, at the same time, not overcook the food. It will readily be apparent to those skilled in this art that this invention may be employed to defrost frozen food and to simmer cook the defrosted food for a long period of time, all in one single operation, without having to attend to the oven at any time after the frozen food is put into the container and the oven set until the food is to be removed from the oven for serving.

Modifications of this invention will occur to those skilled in this art; therefore, it is to be understood that this invention is not limited to the particular embodiments disclosed, but that it is intended to cover all modifications which are within the true spirit and scope of this invention as claimed.

What is claimed is:

1. In a microwave oven for slow cooking, said oven having walls forming an oven cooking cavity, a source of microwave energy, and means for coupling the energy from the microwave source to the oven cavity, the improvement comprising a closed cooking vessel within the microwave oven cavity for supporting food to be heated throughout simultaneously, circuitry for adjusting the microwave energy to a predetermined reduced power level suitable for simmer-cooking and means for monitoring the temperature of the food within the vessel and maintaining it to just below the boiling point, whereby the maximum food temperature is held a plurality of hours to obtain simmer cooking at a slow-cooking rate.

2. The invention of claim 1 wherein the said cooking vessel is of a material that is substantially transparent to microwave energy so that the food in the vessel is adapted to be heated directly by absorption of the microwave energy.

3. The invention of claim 2 wherein the said cooking vessel is formed of a glass-ceramic or stoneware material, and the vessel has a top cover that is at least partially transparent to view.

4. The invention of claim 2 wherein the said temperature monitoring and maintaining means comprises a temperature-sensing probe adapted for insertion into the vessel, control circuitry for the source of microwave energy, and flexible cable means connecting the probe to the control circuitry.

5. The invention of claim 4 wherein the bottom wall of the said closed vessel is provided with a tunnel extending inwardly from the side of the vessel for receiving the temperature-sensing probe therein in a close-fitting relationship, the tip of the probe being located adjacent the center of the bottom wall near the top surface thereof for good thermal conduction of heat from the food load being cooked.

6. The invention of claim 1 wherein the said predetermined power level of the microwave energy is at about 300 to 400 watts.

7. The invention of claim 1 wherein the said temperature controlled, closed cooking vessel is capable of both defrosting a food load from a frozen state and then simmer cooking the food in a single operation.

* * * * *